United States Patent [19]

Gilliatt

[11] 4,371,770

[45] Feb. 1, 1983

[54] ADJUSTABLE MICROWAVE OVEN DOOR SEAL

[75] Inventor: Charles L. Gilliatt, Lawrence, Mass.

[73] Assignee: Raytheon Company, Lexington, Mass.

[21] Appl. No.: 201,668

[22] Filed: Oct. 27, 1980

[51] Int. Cl.[3] ..... H05B 6/76

[52] U.S. Cl. ..... 219/10.55 D; 219/10.55 R; 174/35 GC; 174/35 MS

[58] Field of Search ..... 219/10.55 R, 10.55 D, 219/10.55 A, 10.55 F; 174/35 GC, 35 MS

[56] References Cited

U.S. PATENT DOCUMENTS

| | | | |
|---|---|---|---|
| 2,632,090 | 3/1953 | Revercomb et al. | 219/10.55 F |
| 3,210,512 | 10/1965 | Eason | 219/10.55 D |
| 3,381,605 | 5/1968 | Smith | 219/10.55 R X |
| 3,584,177 | 6/1971 | Bucksbaum | 219/10.55 D |
| 3,668,357 | 6/1972 | Kobayashi | 219/10.55 D |
| 3,767,884 | 10/1973 | Osepchuk et al. | 219/10.55 D |
| 3,956,608 | 5/1976 | Imberg et al. | 219/10.55 D |
| 3,985,993 | 10/1976 | Imberg et al. | 219/10.55 D |
| 4,013,861 | 3/1977 | Westfall | 219/10.55 D |
| 4,146,768 | 3/1979 | Orke et al. | 219/10.55 D |
| 4,166,207 | 8/1979 | Burke | 219/10.55 D |

FOREIGN PATENT DOCUMENTS

| | | | |
|---|---|---|---|
| 2450904 | 4/1975 | Fed. Rep. of Germany | 219/10.55 F |

*Primary Examiner*—B. A. Reynolds
*Assistant Examiner*—Philip H. Leung
*Attorney, Agent, or Firm*—William R. Clark; Milton D. Bartlett; Joseph D. Pannone

[57] ABSTRACT

A door seal for a microwave oven wherein the distance between the choking structure in the door and a substantially planar surface around the periphery of the access opening can be independently adjusted at a plurality of locations around the periphery. The door which is flexible is connected to a rigid door support structure by a plurality of bolts around the periphery of the door. The distance between the door and its support structure can be independently varied at each bolt to conform the contour of the door to the substantially planar surface against which it closes. Accordingly, the choke gap can be optimized around the periphery of the door. The support structure is movable in a vertical plane to open and close the door.

11 Claims, 5 Drawing Figures

ADJUSTABLE MICROWAVE OVEN DOOR SEAL

BACKGROUND OF THE INVENTION

As is well known in the art, microwave ovens must have door seals that substantially prevent the leakage of microwave energy so as to provide a safe environment for operators and to comply with government standards. There are many types of door seals in use today in domestic microwave ovens. However, the technological advances in domestic door seals do not satisfy all of the design requirements which may be presented by a large industrial batch type door seal. For example, it may be preferable that an industrial door open and close readily occupying a minimum of floor space. Also, it may be preferable that the choke structure of the door be of a noncontacting type so as not to be dependent on metal cleanliness or conductivity. Furthermore, it was always desirable to fabricate the door seal as inexpensively as possible such as using relatively light weight sheet metal and conventional sheet metal techniques.

More specifically, many microwave oven seals, both domestic and industrial, employ what has been referred to as a quarter wavelength choking principle. Generally, that is a choke structure whereby there is a one-quarter wavelength electromagnetic path from a gap between the choking surfaces, which path provides a high series reactance at the choke opening and reflects a short circuit from a terminating wall surface at the end of the path to energy directed through the gap. The separation of the choking surfaces at the gap is a critical distance in the performance of the choke. The distance must be large enough so as to prevent arcing between the surfaces but small enough so as to provide effective sealing. A thin layer of a dielectric material over one of the choking surfaces may substantially eliminate the arcing problem. With domestic oven seals, the doors and their frames are generally small enough so that both may be rigidly fabricated so that the distance between them is minimized. However, with large industrial batch type microwave ovens having doors a meter or more wide, it has been found most difficult and expensive to fabricate a rigid door and frame which has a minimum spacing around the periphery.

SUMMARY OF THE INVENTION

The invention discloses a microwave oven comprising a conductive cavity having an access aperture in a wall thereof, a door for substantially preventing the leakage of microwave energy through the access aperture and means for independently adjusting the gap between a portion of the wall around the periphery of the aperture and the door in its closed position at a plurality of locations. It may be preferable that the door contained a quarter-wavelength choke. In an alternate embodiment, the choke may be contained within the portion of the wall around the periphery of the aperture. It may be preferable that the wall portion define a continuous band of substantially planar conductive surface around the periphery of the aperture. Also, the invention may comprise means for moving the door from its closed position a short distance having a horizontal component and then substantially vertically to provide access to the cavity through the aperture.

The invention may also be practiced by a substantially planar conductive surface adjacent and parallel to at least one side of a rectangular access opening to a microwave oven, a door for preventing leakage of microwave energy from the opening, and means for independently adjusting the spacing between the surface and the door in its closed position at a plurality of locations on the surface. The door may comprise a quarter-wavelength choke. It may be preferable that the surface be connected to the cavity wall by a weld.

The invention also discloses a microwave oven comprising a substantially planar conductive surface having an aperture therein for providing access to the processing region of the oven, a door covering and overlapping the aperture, said overlap region being adjacent to a band of said surface around the perimeter of the aperture, and means for providing independent adjustment of the spacing between the door and the band at a plurality of locations around the band.

The invention also defines the combination of a microwave oven enclosure having an access opening in a wall thereof, a substantially planar conductive surface positioned parallel to at least a portion of the perimeter of said access opening and connected to the enclosure, a door for providing a microwave seal for said access opening, and means for adjusting the gap between said surface and said door in the closed position at a plurality of locations.

It may also be preferable that the invention disclose a microwave oven comprising a microwave energy enclosure having an access aperture in a horizontal wall thereof, a rigid door frame connected to the enclosure and having a conductive planar surface forming a band around the aperture in a plane parallel to the wall, a planar door comprising a quarter-wavelength choke, a rigid door support structure comprising means movable in a plane parallel to the surface for opening and closing the door, the means further comprising means for moving the door near its closed position in a direction having a horizontal component to press a perimeter portion of the door against the door frame, and means for independently adjusting the gap between the surface and said portion at a plurality of locations. It may be preferable that the opening and closing means comprise tracks mounted on said frame. Also, it may be preferable that the moving means comprise ridges in the tracks. Also, it may be preferable that the adjusting means comprise a plurality of bolts connecting the door support structure to the door, the connecting distance being adjustable.

BRIEF DESCRIPTION OF THE DRAWINGS

The foregoing and the following description of the preferred embodiment will be more readily understood with reference to the drawings wherein.

DESCRIPTION OF THE PREFERRED EMBODIMENT

Figure 1:
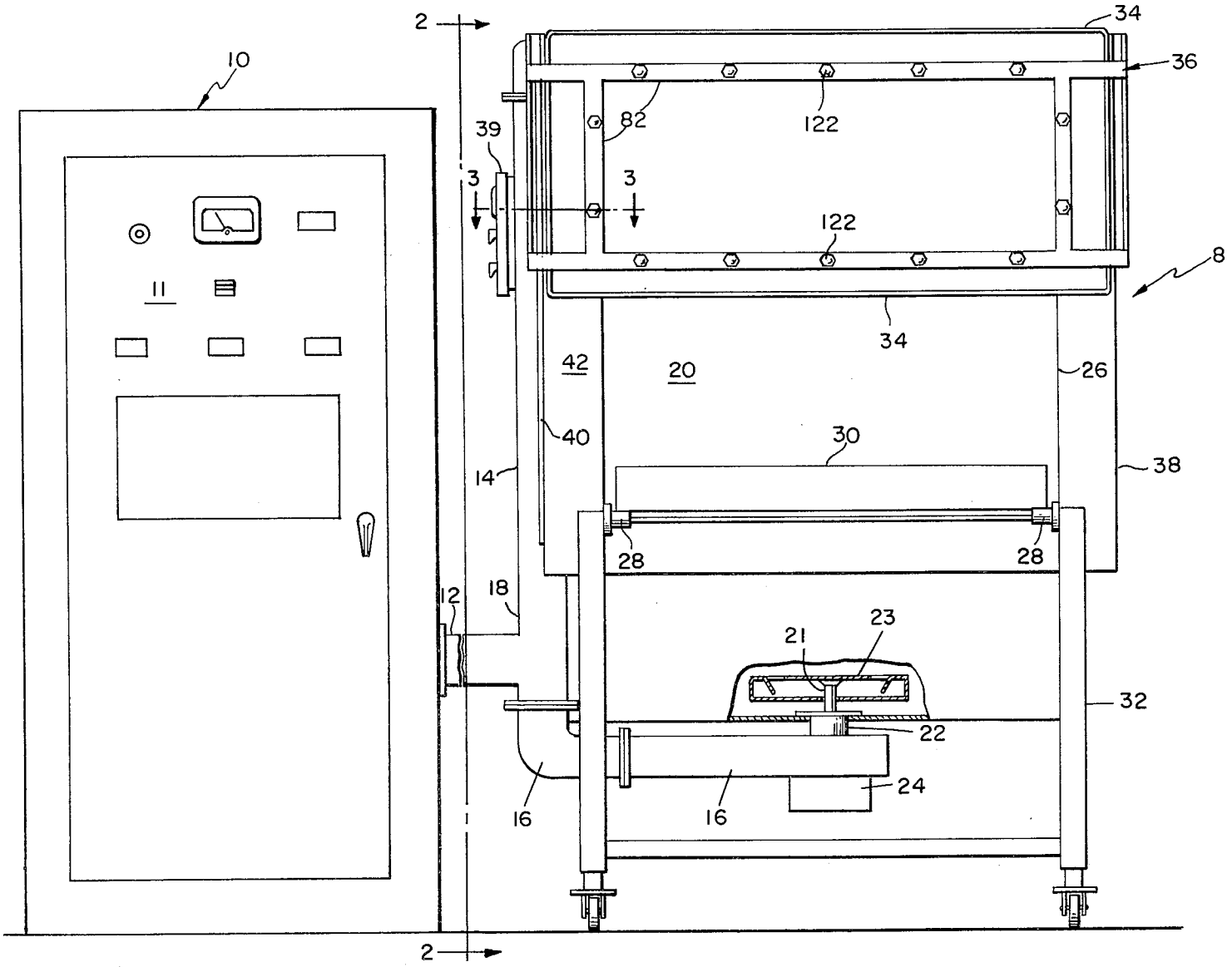
FIG. 1 is a front elevation partially cut away of a microwave oven comprising a microwave source cabinet external to the cavity portion.
Figure 2:
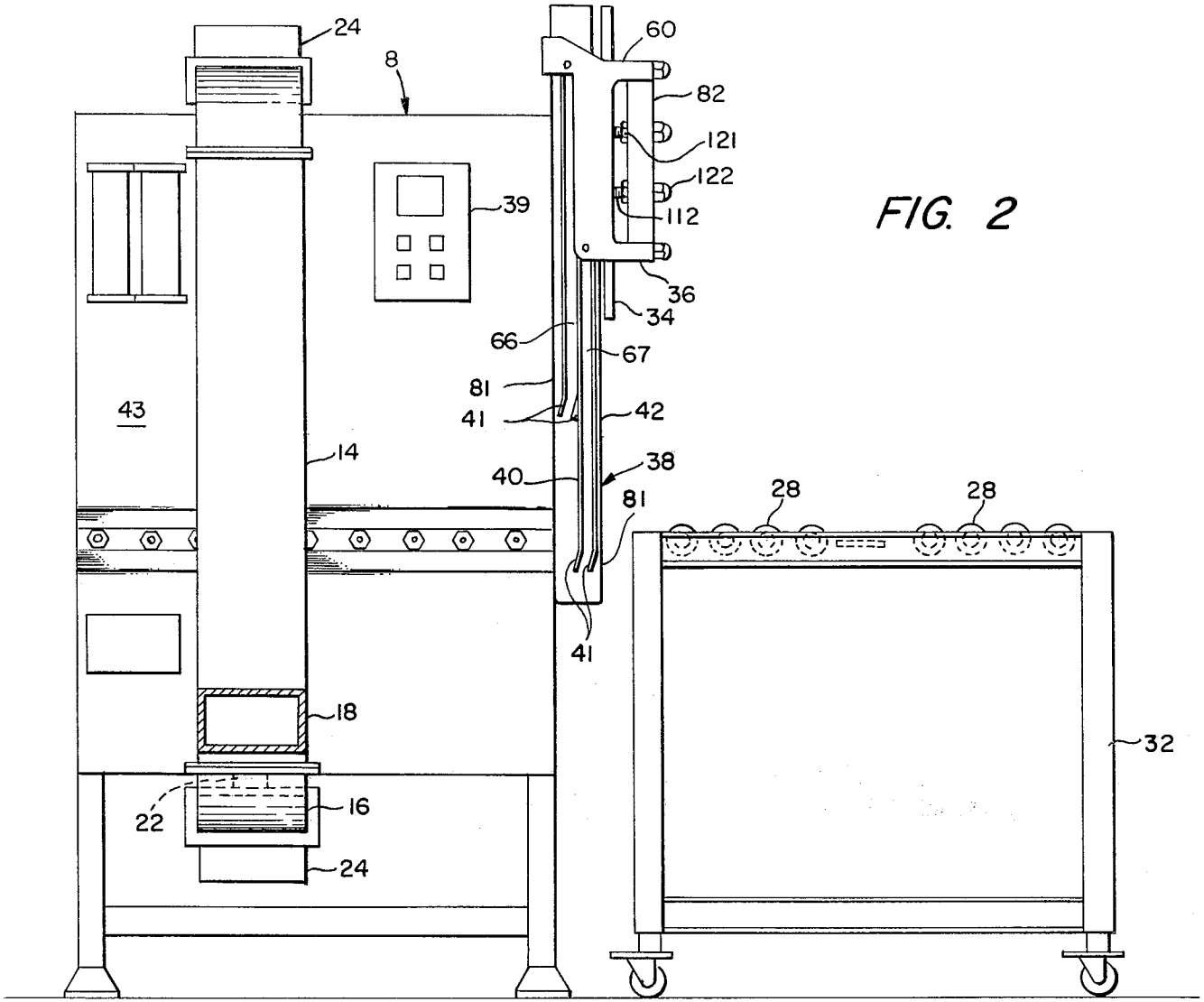
FIG. 2 is a side view of FIG. 1 taken along line 2—2.

Referring to FIG. 1, there is shown a front elevation of a large industrial batch type microwave oven. FIG. 2 is a cut away side view of the microwave cavity portion 8 taken along line 2—2 of FIG. 1. Cabinet 10 is a source of microwave energy and comprises a control panel 11 and a magnetron (not shown) having an output of 30 kilowatts and a frequency of 915 megahertz (MHz). Microwave energy is coupled from cabinet 10 by waveguide 12 which branches to waveguides 14 and 16 at waveguide T 18. Microwave energy in waveguide 14 is coupled into the top of cavity 20 and energy in waveguide 16 is coupled into the bottom. There is a transition from the waveguide to a coaxial conductor 22 to a multiport radiating structure 23. The center conductor 21 of the coaxial conductor is attached on one end to a motor 24 which provides rotation and on the other end to the radiating structure. The invention described later herein could be used to advantage with a number of other types of microwave feed systems. For example, a plurality of magnetrons could be used and they could be physically mounted on cavity portion 8, thus eliminating the external cabinet 10 and waveguides thus far described.

Product is loaded into cavity 20 through access opening 26. Rollers 28 extend from the side walls of the cavity to support tray 30 which is fabricated of polypropylene. Tray 30 may be pulled out onto stand 32 which also has rollers. Product is placed on tray 30 which is then rolled back into the cavity.

The sealing structure for access opening 26 comprises door 34, door support structure 36 and door frame 38. Control panel 39 is used to control the upward and downward movement of door 34 as described in detail later herein.

Figure 3:
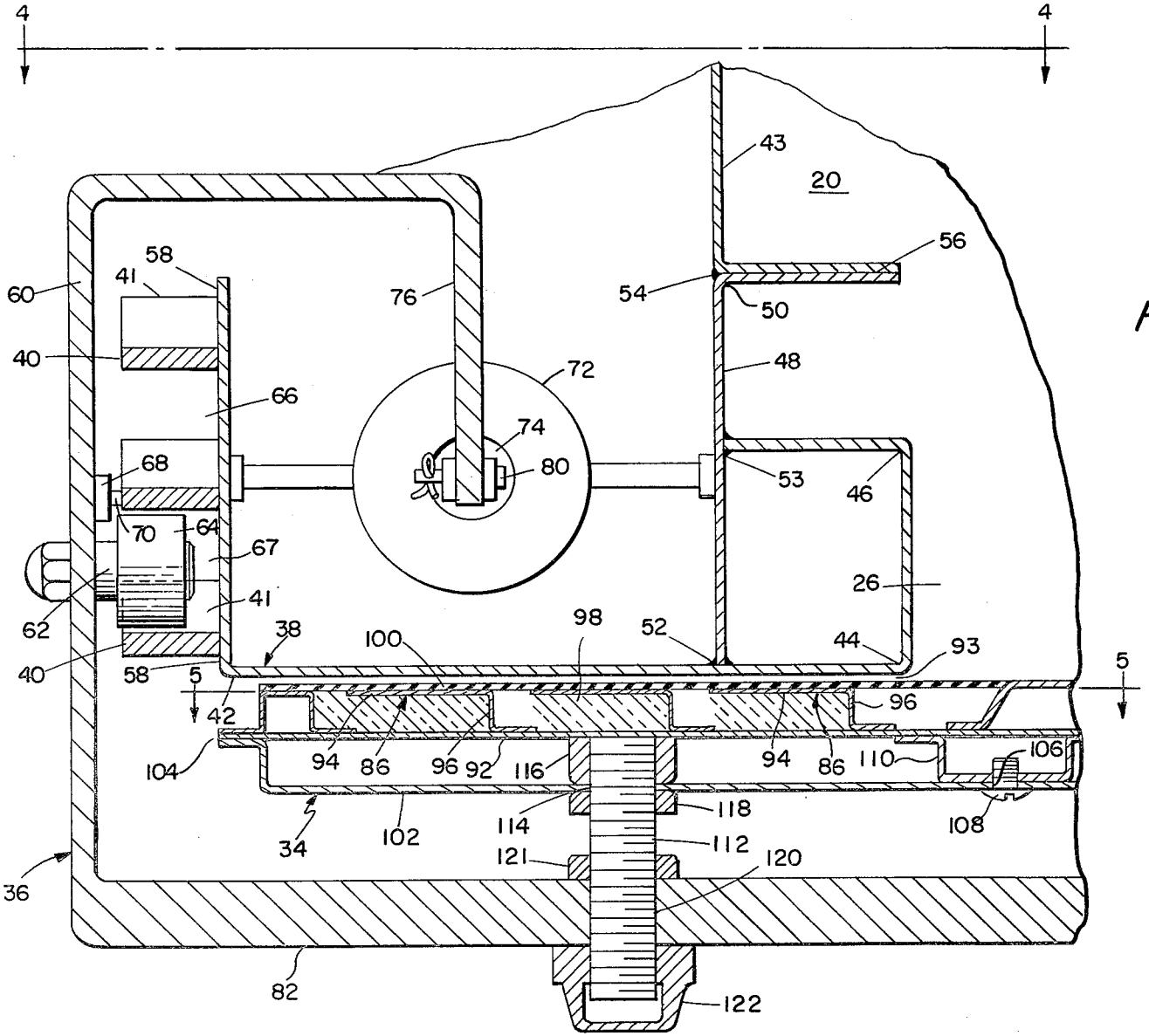
FIG. 3 is a top view of a portion of the oven of FIG. 1 taken along line 3—3.

Referring to FIG. 3, there is shown a top cut away view of a corner of the cavity portion 8 of the microwave oven taken along line 3—3 of FIG. 1. The view shows the door frame 38, door 34 and door support structure 36, all of which are fabricated of a conductive material such as, for example, stainless steel. Door frame 38 has a substantially planar surface or band 42 which is perpendicular to the cavity side walls 43 and forms a continuous band around the periphery of access opening 26. The planar surface forms part of the door seal and is wider than the door enclosed choke structure which will be described later herein; this provides some tolerance in the final position of the door when closed. On the inside of the band so formed, door frame 38 is bent inward at a 90° angle 44 and then inward again at a second 90° angle 46. Bracket 48, which has a 90° bend 50 is welded at points 52, 53 and 54 and provides additional strength and a surface 56 for welding to the wall of the cavity. On the outside of the band so formed, door frame 38 is bent inward to form side panel 58. Metal tracks 40 which are also shown in FIG. 2, are welded to side panel 58.

Parallel to side panel 58 is section 60 of door support structure 36. Extending from section 60 are posts 62 which have rollers 64 on their ends. These rollers, one near the top and one near the bottom of section 60, respectively fit into channels 66 and 67 formed by tracks 40. The roller near the top does not show in FIG. 3 because it is above the cutting line of the figure. A guide 68 with a tensioned roller 70 limits the lateral movement of door support structure 36.

In operation, door 34, which is attached to door support structure 36, is opened and closed by hydraulic cylinder 72 which has a plunger 74 extending therefrom. When fluid under pressure is applied to cylinder 72 which is attached to door frame 38, the plunger extends from the cylinder applying an upward force to bracket 76 of the door support structure at a connection point comprising a clevis pin 80 through bracket 76 and plunger 74. Cylinders are provided at both the left and right sides of door frame 38. The upward movement of door support structure 36 is guided by rollers 64 in channels 66 and 67. In the downward direction which is also controlled by the hydraulic cylinders, rollers descend vertically to respective points 81 where they are simultaneously guided in a direction having a horizontal component by track ridges 41. The movement of the door support structure in the horizontal direction causes door 34 to be pressed against the band of door frame 38. Door support structure 36 further comprises a rectangular structure 82 which is connected to section 60.

Door 34 which is connected to rectangular structure 82 houses a microwave choke which comprises a plurality of metal fingers 86 which are arranged in rows that are substantially parallel to the periphery of the door. Each row of fingers forms a quarter wavelength choke as described in detail in U.S. Pat. No. 3,767,889, issued to John M. Osepchuk and assigned to the same assignee herein, which patent is hereby incorporated by reference.

After fingers 86 are attached to metal sheet 92 to form a plurality of rectangular surfaces 94 parallel to metal sheet 92 and choke terminating surfaces 96 perpendicular thereto, a potting compound 98 is poured into the finger chokes and allowed to harden. An example of a potting compound is a silicon rubber from the Dow Corning RTV family. The compound provides support for the fingers which would otherwise be very flexible as extended from sheet 92. Furthermore, because it is preferable that the distance from the finger opening to the short circuit surface 96 of the finger be one-quarter wavelength of the microwave energy, it is desirable to use a potting compound having a dielectric coefficient which substantially reduces the wavelength and therefore reduces the size of the fingers. In the preferred embodiment operating at 915 MHZ, the length of the fingers perpendicular to sheet 92 is approximately 1.8 inches. Also, the potting compound prevents buildup of foreign material within the choke structure.

A thin layer 100 of silicon rubber is attached over the rows of fingers 86 to provide a barrier so that there is no arcing to the band of door frame 38 when the door is closed and pressed up against it. Metal sheet 92 has outside metal sheet 102 welded to it at fused edge 104. Holes 106 are drilled in outside metal sheet 102 at various places and bolts 108 are put therethrough and secured to brackets 110 which are welded to metal sheet 92. Brackets 110 provide support and maintain a spacing between sheet 92 and sheet 102.

Rectangular structure 82 of door support structure 36 is connected to door 34 by fourteen bolts 112 which are spaced somewhat evenly around the rectangle. Bolts 112 pass through holes 114 in the outside metal sheet 102 and are welded to metal sheet 92. Spacer blocks 116 which surround bolts 112 between sheets 92 and 102 provide additional strength for the structure. Nut 118 presses the outside of metal sheet 102 against block 116 to make the attachment between bolt 112 and door 34 more secure. Bolts 112 extend to rectangular structure 82 and pass through holes 120 therein. On the inside of rectangular structure 82, nut 121 prevents bolt 112 from moving in a direction away from the microwave oven. On the outside of rectangular structure 82, nut 122 prevents the bolt from moving in a direction toward the microwave oven. By loosening either nut 121 or nut 122, moving bolt 112 in the direction of the loosened nut, and then tightening the other nut down to the rectangular structure, the distance that bolt 112 extends toward the microwave oven can be changed. Using this technique, the gap between the band planar surface 42 of the door frame and the door can be individually varied at fourteen locations around the periphery of the door. Using this technique, the door is adjusted to the frame around its periphery.

Figure 4:
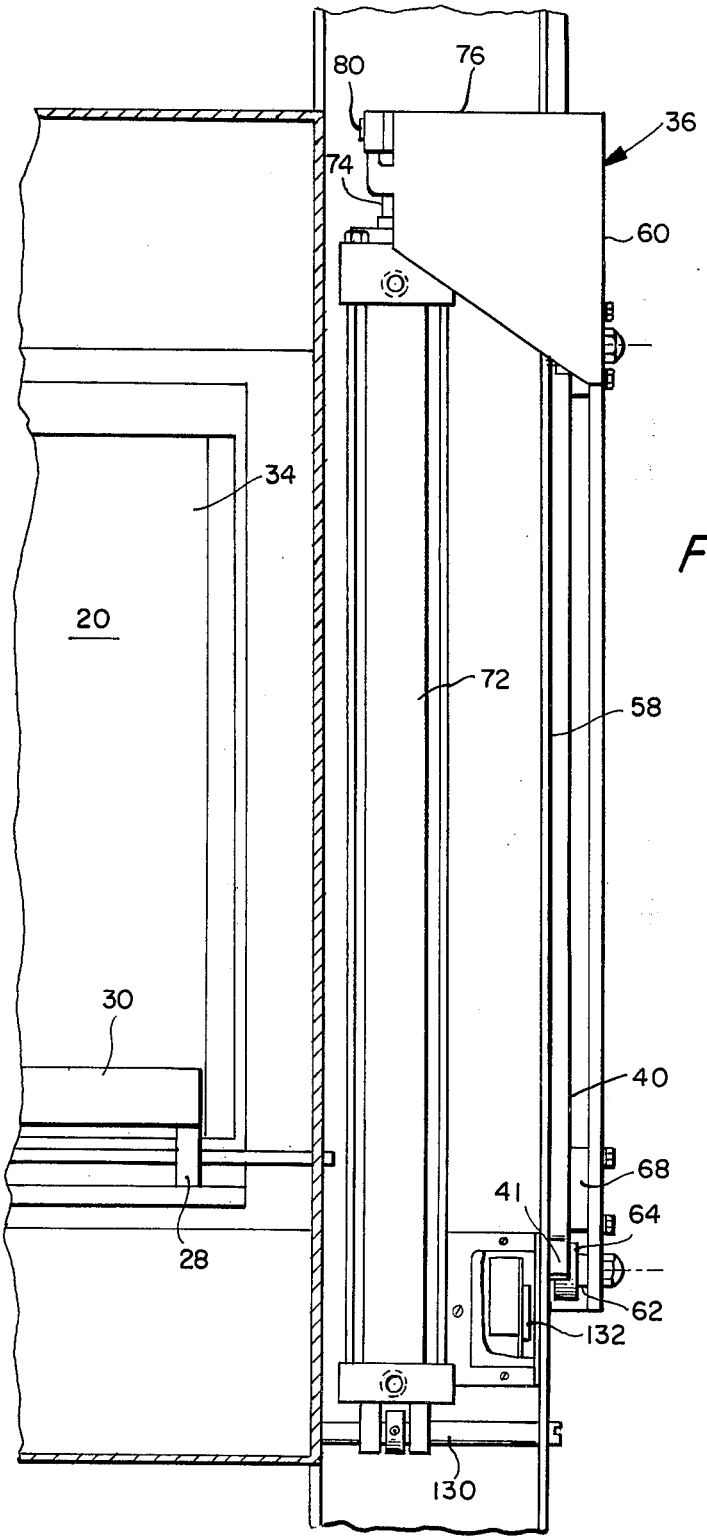
FIG. 4 is a view taken along line 4—4 of FIG. 3 except that the door is in its closed position.

Referring to FIG. 4, a back view taken along line 4—4 of FIG. 3 is shown with the door in the descended or closed position. The figure more clearly shows hydraulic cylinder 72 with plunger 74 substantially encased therein. Cylinder 72 is supported at its bottom by rod 130. The hydraulic attachments to cylinder 72 and their connections to the control panel are not shown as they are well known in the art. Interlock 132 senses the downward position of the door and prevents the excitation of microwave energy to the cavity when it is not properly sealed.

Figure 5:
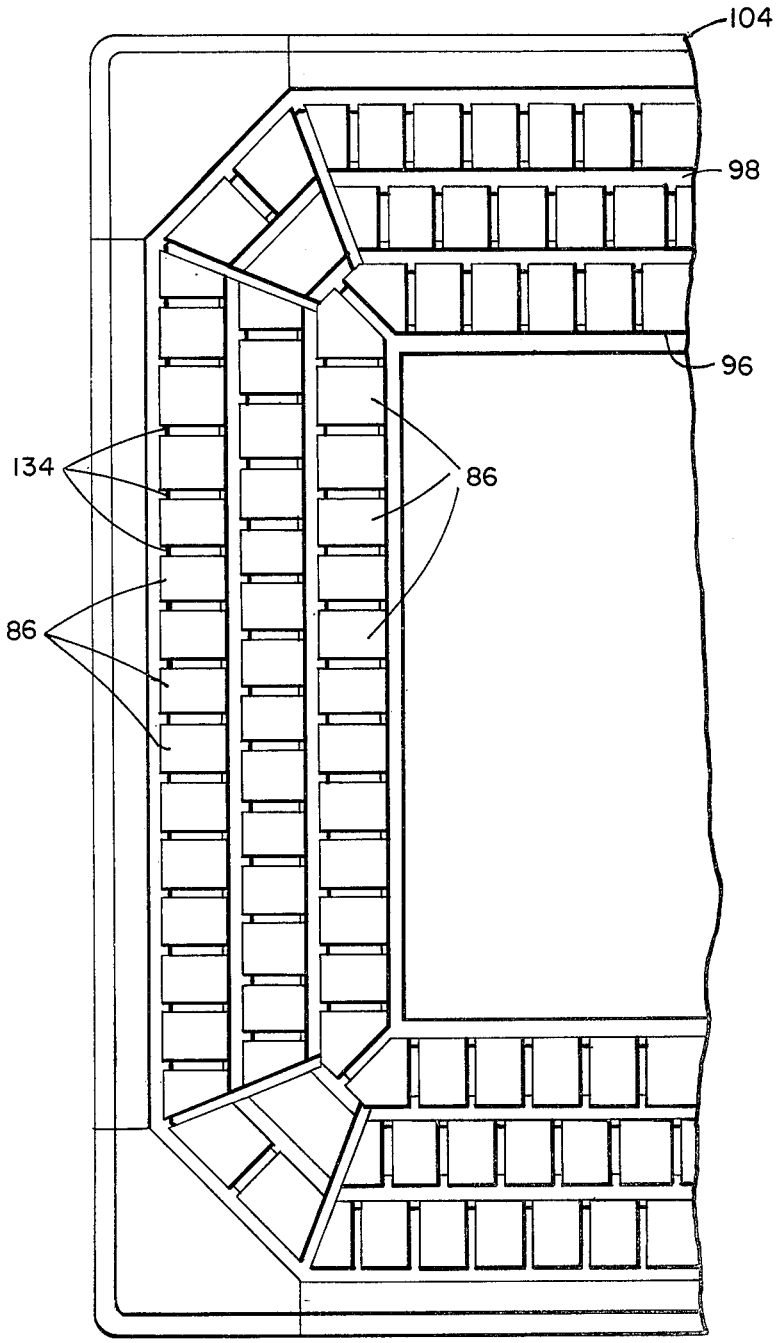
FIG. 5 is a cut-away view of the door as taken along line 5—5 of FIG. 3.

Referring to FIG. 5, a cut away view of door 34 is shown as taken along line 5—5 of FIG. 3. Three substantially parallel rows of metal fingers 86 which comprise the choke are shown. Slots 134 between the fingers substantially prevent the propagation of energy in a peripheral direction through the choke as described in the patent herein earlier incorporated by reference. Although one row of fingers may have been adequate to substantially provide a microwave seal even further suppression is attained by the additional two rows.

In operation, the gap 93 between the band of door frame 38 and door 34 is adjusted after fabrication and then no further adjustment should be necessary except for perhaps after an extended time of usage. Just for example, suppose that after the door is initially fitted, it is found that the top left of the door fits so tightly that the door won't close in its descended position and the bottom left of the door has a gap between it and the frame which is one-eighth of an inch greater than optimum. On the top left side of the door, nut 121 would be loosened and then nut 122 would be tightened towards it thus moving bolt 112 and the upper left hand corner of the attached door towards door support structure 36 and away from door frame 38. To perform the opposite adjustment at the bottom of the door, nut 122 would be loosened and nut 121 tightened towards it moving bolt 112 and the lower left hand corner of the door towards the band of the door frame. In essence, in the lowered position, the band of door frame 38 has a rigid fixed relationship with the rectangular structure 82 of door support structure 36. Then, in an initial adjustment, the distance of the door at different points around the door from the door support structure is adjusted. By altering these distances, the separating distance between the door and its frame at the same points are altered. Accordingly, a door which is intentionally fabricated to be somewhat flexible is adjusted to a rigid fixed door frame which does not even have to be absolutely planar. The fact that the door frame and door do not have to be made absolutely planar but rather one can be adjusted to the other substantially reduces fabrication costs. To make them absolutely planar, machining is generally required as the fabrication technique. With the invention, the various parts described herein can be formed from stainless steel sheets using sheet metal techniques. The adjustment limit at each bolt may be approximately one-quarter inch.

This concludes the description of the preferred embodiment. Many modifications will be apparent to one skilled in the art from the reading hereof without departing from the spirit and scope of the invention. Accordingly, it is intended that the scope of the invention be limited only by the appended claims.

What is claimed:

1. A microwave oven comprising:

a conductive cavity having an access aperture surrounded by a substantially planar conductive band;

a door covering said access aperture, a region of said door overlapping said band, said region and said band having spatial separation defining a gap therebetween;

means for energizing said cavity with microwave energy;

a quarter-wavelength choke communicating with said gap wherein the entrance to said coke is substantially perpendicular to said band; and means for independently adjusting the distance of said gap at a plurality of locations around said band.

2. The oven recited in claim 1 wherein said quarter-wavelength choke is housed within said door.

3. The oven recited in claim 1 further comprising means for opening said door comprising means for moving said door a short distance having a horizontal component and then substantially vertical to provide access to the cavity through said aperture.

4. A microwave oven comprising:

a substantially rectangular microwave cavity wherein one of the walls comprises a substantially planar conductive surface having an aperture therein for providing access to said cavity;

means for energizing said cavity with microwave energy;

a door covering said aperture and overlapping said one of said walls, the overlap region of said door and said wall being spaced wherein a gap is provided therebetween;

a quarter-wavelength choke defining a microwave transmission path in parallel with a microwave transmission path through said gap; and means for providing independent adjustment of the distance of said gap at a plurality of locations around said aperture.

5. The oven recited in claim 4 wherein said door houses said quarter-wavelength choke.

6. The oven recited in claim 4 further comprising means for opening said door comprising means for moving said door a short distance having a horizontal component and then substantially vertical to provide access to the cavity through said aperture.

7. In combination:

a microwave oven enclosure comprising a wall having an access opening therein;

a substantially planar conductive surface positioned parallel to at least a portion of the perimeter of said access opening and connected to said enclosure;

means for energizing said enclosure with microwave energy;

a door for providing a microwave seal for said access opening, said door having a region overlapping said planar conductive surface, said door comprising a quarter-wavelength choke having its entrance facing said planar conductive surface;

said region of said door being spaced from said planar conductive surface defining a gap therebetween; and means for independently adjusting the distance of said gap at a plurality of locations around said opening.

8. A microwave oven comprising:

a microwave energy enclosure comprising a horizontal wall having an access aperture therein;

a rigid door frame connected to said enclosure and having a conductive planar surface forming a band around said aperture in a plane parallel to said wall;

a planar door comprising a quarter-wavelength choke;

a rigid door support structure comprising means movable in a plane parallel to said surface for opening and closing said door;

said opening and closing means further comprising means for moving said door near its closed position in a direction having a horizontal component to a position where said door and said door frame are separated by a small gap; and means for independently adjusting the distance of said gap at a plurality of locations around said conductive planar surface.

9. The oven recited in claim 8 wherein said opening and closing means comprises tracks mounted on said frame.

10. The oven recited in claim 9 wherein said means for moving comprises a ridge in said tracks.

11. The oven recited in claim 8 wherein said adjusting means comprises a plurality of bolts connecting said door support structure to said door, the connecting distance between the door support structure and the door being adjustable at each bolt.

* * * * *